US009005045B2

(12) United States Patent
Dingman

(10) Patent No.: US 9,005,045 B2
(45) Date of Patent: Apr. 14, 2015

(54) GOLF CLUB GRIP WITH IRREGULAR PENTAGON SHAPE AND/OR DUAL SHAFT RECEIVING APERTURES

(75) Inventor: Darin Dingman, Livonia, MI (US)

(73) Assignee: SSG International, LLC, Wixom, MI (US)

( * ) Notice: Subject to any disclaimer, the term of this patent is extended or adjusted under 35 U.S.C. 154(b) by 146 days.

(21) Appl. No.: 13/571,332

(22) Filed: Aug. 9, 2012

(65) Prior Publication Data

US 2014/0045602 A1 Feb. 13, 2014

(51) Int. Cl.

| | |
|---|---|
| ***A63B 69/36*** | (2006.01) |
| ***A63B 53/14*** | (2006.01) |
| *A63B 53/00* | (2006.01) |
| *A63B 53/16* | (2006.01) |

(52) U.S. Cl.

CPC ..... *A63B 53/14* (2013.01); *A63B 53/007* (2013.01); *A63B 53/145* (2013.01); *A63B 53/16* (2013.01)

(58) Field of Classification Search

USPC ..... 473/201, 203, 204, 206, 219, 226; D21/756

See application file for complete search history.

(56) References Cited

U.S. PATENT DOCUMENTS

| | | | | | |
|---|---|---|---|---|---|
| 2,877,018 | A | | 3/1959 | Turner | |
| D221,345 | S | * | 8/1971 | Dworak | D21/756 |
| 3,782,725 | A | | 1/1974 | Giambazi | |
| 4,065,127 | A | | 12/1977 | Fagan | |
| 4,067,573 | A | | 1/1978 | Key, Jr. | |
| 4,215,860 | A | | 8/1980 | Nakamatsu | |
| 4,269,412 | A | | 5/1981 | Hughes | |
| 4,272,077 | A | | 6/1981 | Spivey | |
| 4,310,158 | A | | 1/1982 | Hoffman | |
| 4,629,191 | A | * | 12/1986 | Mancuso | 473/203 |
| 4,746,120 | A | | 5/1988 | Mockovak | |
| 5,209,475 | A | * | 5/1993 | Loman | 473/294 |
| D355,444 | S | * | 2/1995 | Deluca | D21/756 |
| 5,460,372 | A | | 10/1995 | Cook | |
| 5,575,473 | A | | 11/1996 | Turner | |
| 5,575,724 | A | * | 11/1996 | Hannon et al. | 473/315 |
| 5,647,806 | A | | 7/1997 | McDevitt | |
| D407,455 | S | | 3/1999 | Dolce | |
| 6,723,001 | B2 | | 4/2004 | Ferris | |
| 8,096,893 | B2 | | 1/2012 | Ferris | |

FOREIGN PATENT DOCUMENTS

| | | | |
|---|---|---|---|
| CA | 491808 | A | 7/1953 |
| GB | 137448 | A | 1/1920 |
| WO | 2012/010609 | A1 | 1/2012 |

* cited by examiner

*Primary Examiner* — Nini Legesse

(74) *Attorney, Agent, or Firm* — Harness, Dickey & Pierce

(57) ABSTRACT

A golf club grip includes an elongated body having an irregular pentagon-shaped five-sided cross-section with a contoured periphery and a consistent cross section along a longitudinal length of the body. The body can have at least one aperture formed therein. The at least one aperture can include first and second apertures defined by hollow cylindrical openings extending through one longitudinal end of the body. Each of the first and second apertures can have a longitudinal axis, which can extend parallel to one another. The longitudinal axes can define a plane extending in a direction generally perpendicular to a putter head face to be assembled to the body for right handed and left handed golfers, wherein a putter shaft to be located in either of the first and second apertures during assembly provides either an offset position or an onset position of a putter face with respect to the grip.

20 Claims, 2 Drawing Sheets

GOLF CLUB GRIP WITH IRREGULAR PENTAGON SHAPE AND/OR DUAL SHAFT RECEIVING APERTURES

FIELD OF THE INVENTION

The invention relates to a golf club grip for a putter, where the golf club grip has a generally irregular pentagon-shaped cross section of consistent dimension along a longitudinal length, and more particularly, to a golf club grip for a putter, where the golf club grip has dual shaft receiving apertures.

BACKGROUND

Various golf club grip configurations for putters are known in the art as can be seen from U.S. Pat. No. 8,096,893; U.S. Pat. No. 6,723,001; U.S. Pat. No. 5,647,806; U.S. Pat. No. 5,575,473; U.S. Pat. No. 5,460,372; U.S. Pat. No. 4,746,120; U.S. Pat. No. 4,215,860; and WO2012/010609A1. While each of these golf club grips appear to be suitable for its intended use on a putter, the known putter grips lack one or more desirable features. In particular, it would be desirable to provide a golf club grip with a generally irregular pentagon-shaped cross section of consistent dimension along a longitudinal length. Alternatively or additionally, it would be desirable to provide a golf club grip with two barrels or apertures in line with a putting direction allowing the grip to be installed on a putter shaft with an offset or an onset with respect to a face of a putter.

SUMMARY

A golf club grip can include an elongated body having an irregular pentagon-shaped five-sided cross-section. The irregular pentagon-shaped five sided cross-section can include a contoured shape and/or rounded angles. The irregular pentagon-shaped cross-section of the body can be a consistent cross-section along a longitudinal length of the body. The consistent cross-section of the body can extend along an entire longitudinal length of the body. At least one aperture can be provided in the body defining a hollow cylindrical opening through one longitudinal end of the body. The at least one aperture can include a single aperture centered on a longitudinal axis of the body. Alternatively, the at least one aperture can include first and second apertures defining first and second hollow cylindrical openings through one longitudinal end of the body. Each of the first and second apertures can have a longitudinal axis. The longitudinal axes of the first and second apertures can extend parallel to one another. The longitudinal axes of the first and second apertures can define a plane extending in a direction generally perpendicular to a putter head face to be assembled to the body for right handed and left handed golfers. During assembly, a putter shaft can be located in either of the first and second apertures to selectively provide either an offset position or an onset position of a putter head face with respect to the body for a right handed golfer or a left handed golfer.

A golf club grip can include an elongated body having first and second elongated hollow cylindrical apertures extending into the body from one longitudinal end. Each of the first and second apertures can have a longitudinal axis. The longitudinal axes of the first and second apertures can extend parallel to one another. The longitudinal axes of the first and second apertures can define a plane extending in a direction generally perpendicular to a putter head face to be assembled to the body for right handed and left handed golfers. During assembly, a putter shaft can be located in either of the first and second apertures to selectively provide either an offset position or an onset position of a putter head face with respect to the body for a right handed golfer or a left handed golfer. The body can include an irregular pentagon-shaped five-sided cross-section. The irregular pentagon-shaped five-sided cross-section can have at least one of a contoured periphery and rounded angles. The irregular pentagon-shaped five-sided cross-section of the body can have a consistent cross-section along a longitudinal length. The consistent cross-section can extend along an entire longitudinal length of the body.

A golf club grip can include a body having an irregular pentagon-shaped five-sided cross-section. The irregular pentagon-shaped five-sided cross-section can include a contoured periphery and/or rounded angles. The irregular pentagon-shaped five-sided cross-section of the body can include a consistent cross-section along a longitudinal length of the body. The consistent cross-section of the body can extend along an entire longitudinal length of the body. The body can include first and second apertures defining hollow cylindrical openings through one longitudinal end of the body. Each of the first and second apertures can have a longitudinal axis. The longitudinal axes of the first and second apertures can extend parallel to one another. The longitudinal axes can define a plane extending in a direction generally perpendicular to a putter head face to be assembled to the body for right handed and left handed golfers. During assembly, a putter shaft can be located in either of the first and second apertures to selectively provide either an offset position or an onset position of a putter head face with respect to the body for a right handed golfer and a left handed golfer. The irregular pentagon-shaped five-sided cross-section of the body can have a side of longest dimension extending generally parallel to the plane defined by the longitudinal axes of the first and second apertures. A cylindrical plug can be provided for filling any unused aperture in the body during assembly.

The body of the golf club grip can include no taper and can include two hollow cylindrical shaft-receiving barrels inside the body of the golf club grip. During assembly, a golf club shaft can be installed in the far right side (for a right handed golfer) of the body of the golf club grip and this will create offset and position a lead hand of a right handed golfer in a position more in front of the ball. Alternatively, during assembly, a golf club shaft can be installed in the far left side (for a right handed golfer) of the body of the golf club grip and this will create onset which moves a lead hand of a right handed golfer back closer to square or slightly behind the ball. During assembly, a golf club shaft can be installed in the far left side (for a left handed golfer) of the body of the golf club grip and this will create offset and position a lead hand of a left handed golfer in a position more in front of the ball. Alternatively, during assembly, a golf club shaft can be installed in the far right side (for a left handed golfer) of the body of the golf club grip and this will create onset which moves a lead hand of a left handed golfer back closer to square or slightly behind the ball. There is a distinct advantage either way the grip is installed. The same style golf club grip can be provided with one barrel straight down the middle.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
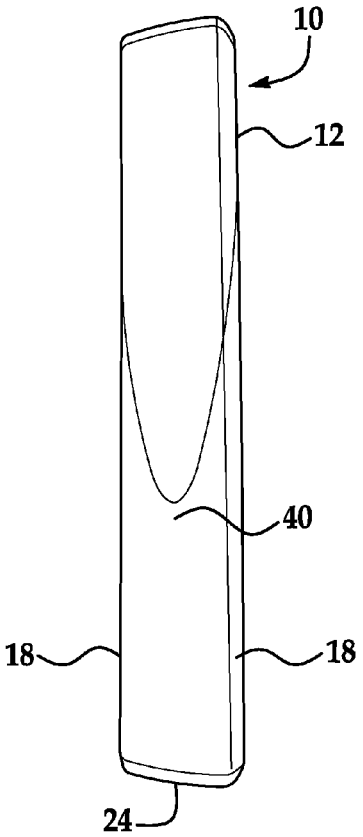
FIG. 1 is a front elevational view of a golf club grip.
Figure 2:
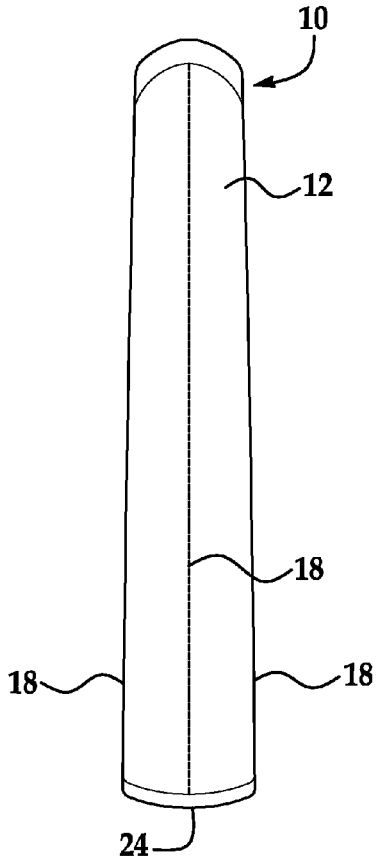
FIG. 2 is a rear elevational view of the golf club grip of FIG. 1.
Figure 3A:
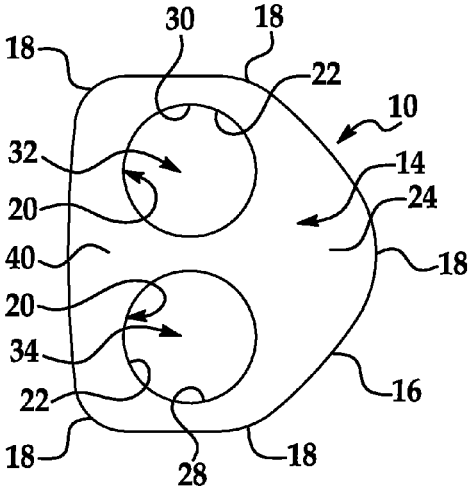
FIG. 3A is a bottom end view of the golf club grip of FIGS. 1-2.
Figure 3B:
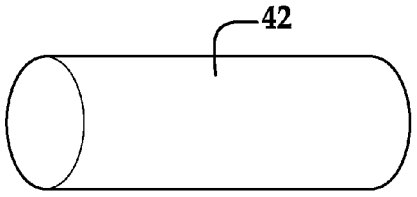
FIG. 3B is a perspective view of a plug for filling any unused aperture in the golf club grip during assembly.
Figure 4:
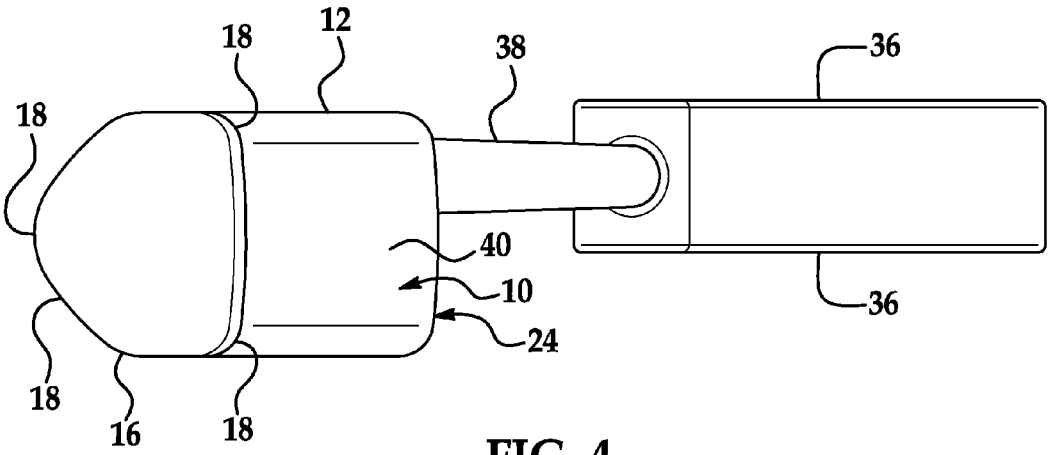
FIG. 4 is a top view of the golf club grip of FIGS. 1-3 with an attached shaft and putter head illustrating an onset putter head position for a right hand golfer, or offset putter head position for a left hand golfer.
Figure 5:
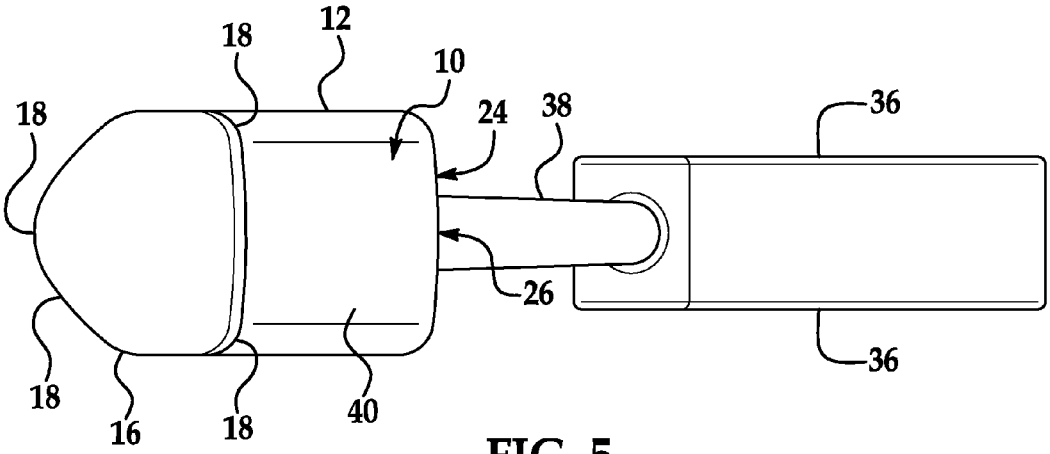
FIG. 5 is a top view of the golf club grip having a single centrally located aperture with an attached shaft and putter head illustrating a centered putter head position for a right hand golfer or a left hand golfer.
Figure 6:
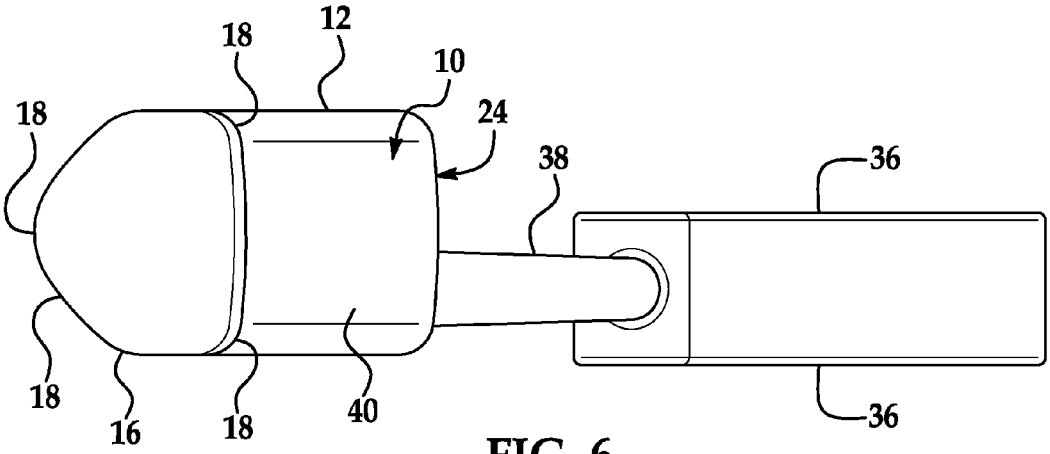
FIG. 6 is a top view of the golf club grip of FIGS. 1-3 with an attached shaft and putter head illustrating an offset putter head position for a right hand golfer, or onset putter head position for a left hand golfer.

Referring now to FIGS. 1-6, a golf club grip 10 can include an elongated body 12 having an irregular pentagon-shaped five-sided cross-section 14. The irregular pentagon-shaped five sided cross-section 14 can include a contoured shape 16 and/or rounded angles 18. The irregular pentagon-shaped cross-section 14 of the body 12 can be a consistent cross-section 14 along a longitudinal length of the body 12. The consistent cross-section 14 of the body 12 can extend along an entire longitudinal length of the body 12. At least one aperture 20 can be provided in the body 12 defining a hollow cylindrical opening 22 through one longitudinal end 24 of the body 12. As best seen in FIG. 5, the at least one aperture 20 can include a single aperture 26 centered on a longitudinal axis of the elongated body 12. Alternatively, as best seen in FIGS. 3A, 4 and 6, the at least one aperture 20 can include first and second apertures 28, 30 defining first and second hollow cylindrical openings 32,34 through one longitudinal end 24 of the body 12. Each of the first and second apertures 28, 30 can have a longitudinal axis. The longitudinal axes of the first and second apertures 28, 30 can extend parallel to one another. The longitudinal axes of the first and second apertures 28, 30 can define a plane extending in a direction generally perpendicular to a putter head face 36 to be assembled to the body 12 for right handed and left handed golfers. During assembly, a putter shaft 38 can be located in either of the first and second apertures 28, 30 to selectively provide either an offset position (FIG. 4 for left handed golfers; FIG. 6 for right handed golfers) or an onset position (FIG. 4 for right handed golfers; FIG. 6 for left handed golfers) of a putter head face 36 with respect to the body 12 for a right handed golfer or a left handed golfer.

A golf club grip 10 can include an elongated body 12 having first and second elongated hollow cylindrical apertures 28, 30 extending into the body 12 from one longitudinal end 24. Each of the first and second apertures 28, 30 can have a longitudinal axis. The longitudinal axes of the first and second apertures 28, 30 can extend parallel to one another. The longitudinal axes of the first and second apertures 28, 30 can define a plane extending in a direction generally perpendicular to a putter head face 36 to be assembled to the body 12 for right handed and left handed golfers. During assembly, a putter shaft 38 can be located in either of the first and second apertures 28, 30 to selectively provide either an offset position (FIG. 4 for left handed golfers; FIG. 6 for right handed golfers) or an onset position (FIG. 4 for right handed golfers; FIG. 6 for left handed golfers) of a putter head face 36 with respect to the body 12 for a right handed golfer or a left handed golfer. The body 12 can include an irregular pentagon-shaped five-sided cross-section 14. The irregular pentagon-shaped five-sided cross-section 14 can have a contoured shape 16 and/or rounded angles 18. The irregular pentagon-shaped five-sided cross-section 14 of the body 12 can have a consistent cross-section 14 along a longitudinal length. The consistent cross-section 14 can extend along an entire longitudinal length of the elongated body 12.

A golf club grip 10 can include an elongated body 12 having an irregular pentagon-shaped five-sided cross-section 14. The irregular pentagon-shaped five-sided cross-section 14 can include a contoured periphery 16 and/or rounded angles 18. The irregular pentagon-shaped five-sided cross-section 14 of the body 12 can include a consistent cross-section 14 along a longitudinal length of the elongated body 12. The consistent cross-section 14 of the body 12 can extend along an entire longitudinal length of the elongated body 12. The body 12 can include first and second apertures 28, 30 defining hollow cylindrical openings 32, 34 through one longitudinal end 24 of the body 12. Each of the first and second apertures 28, 30 can have a longitudinal axis. The longitudinal axes of the first and second apertures 28, 30 can extend parallel to one another. The longitudinal axes can define a plane extending in a direction generally perpendicular to a putter head face 36 to be assembled to the body 12 for right handed and left handed golfers. During assembly, a putter shaft 38 can be located in either of the first and second apertures 28, 30 to selectively provide either an offset position (FIG. 4 for left handed golfers; FIG. 6 for right handed golfers) or an onset position (FIG. 4 for right handed golfers; FIG. 6 for left handed golfers) of a putter head face 36 with respect to the body 12 for a right handed golfer and a left handed golfer. The irregular pentagon-shaped five-sided cross-section 14 of the body 12 can have a side 40 of longest dimension extending generally parallel to the plane defined by the longitudinal axes of the first and second apertures 28, 30. As best seen in FIG. 3B, a plug 42 can be provided for filling any unused aperture 28, 30 in the body 12 during assembly.

The body 12 of the golf club grip 10 can include no taper and can include two hollow cylindrical shaft-receiving barrels 28, 30 inside the body 12 of the golf club grip 10. During assembly, a golf club shaft 38 can be installed in the far right side aperture 28 (FIG. 6 for a right handed golfer) of the body 12 of the golf club grip 10 and this will create an offset position and locate a lead hand of a right handed golfer in a position more in front of a ball when addressing the ball for a put. Alternatively, during assembly, a golf club shaft 38 can be installed in the far left side aperture 30 (FIG. 4 for a right handed golfer) of the body 12 of the golf club grip 10 and this will create an onset position which moves a lead hand of a right handed golfer back closer to square or slightly behind a ball when addressing the ball for a put. During assembly, a golf club shaft 38 can be installed in the far left side aperture 30 (FIG. 4 for a left handed golfer) of the body 12 of the golf club grip 10 and this will create an offset position and locate a lead hand of a left handed golfer in a position more in front of a ball when addressing the ball for a put. Alternatively, during assembly, a golf club shaft 38 can be installed in the far right side aperture 28 (FIG. 6 for a left handed golfer) of the body 12 of the golf club grip 10 and this will create an onset position which moves a lead hand of a left handed golfer back closer to square or slightly behind the ball when addressing the ball for a put. There is a distinct advantage either way the grip 10 is installed. As best seen in FIG. 5, the same style golf club grip 10 can be provided with one barrel, or single aperture 26, straight down the middle.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A golf club grip comprising:

an elongated body having an irregular pentagon-shaped five-sided cross-section with at least one side longer than one of the other sides, rounded angles and a consistent cross-section along a longitudinal length.

2. The golf club grip of claim 1 further comprising:

the consistent cross-section extending along an entire longitudinal length of the elongated body.

3. The golf club grip of claim 1 further comprising:

at least one aperture defining a hollow cylindrical opening through one longitudinal end of the elongated body.

4. The golf club grip of claim 3, wherein the at least one aperture is centered on a longitudinal axis of the elongated body.

5. The golf club grip of claim 3, wherein the at least one aperture further comprises first and second apertures.

6. The golf club grip of claim 5, wherein each of the first and second apertures has a longitudinal axis.

7. The golf club grip of claim 6, wherein the longitudinal axes of the first and second apertures extending parallel to one another.

8. The golf club grip of claim 6, wherein the longitudinal axes define a plane extending in a direction generally perpendicular to a putter head face to be assembled to the body for right handed golfers and left handed golfers.

9. The golf club grip of claim 6, wherein during assembly a putter shaft can be located in either of the first and second apertures to selectively provide an offset position or an onset position of a putter head face with respect to the body for right handed golfers and left handed golfers.

10. A golf club grip comprising:

an elongated single monolithic body having first and second hollow cylindrical apertures extending into the elongated single monolithic body from one longitudinal end.

11. The golf club grip of claim 10, wherein each of the first and second apertures has a longitudinal axis.

12. The golf club grip of claim 11, wherein the longitudinal axes of the first and second apertures extending parallel to one another.

13. The golf club grip of claim 11, wherein the longitudinal axes of the first and second apertures define a plane extending generally perpendicular to a putter head face to be assembled to the body for right handed golfers and left handed golfers.

14. The golf club grip of claim 11, wherein during assembly a putter shaft can be located in either of the first and second apertures to selectively provide either an offset position or an onset position of a putter head face with respect to the body for right handed golfers and left handed golfers.

15. The golf club grip of claim 10 further comprising:

an irregular pentagon-shaped five-sided cross-section of the body with at least one side longer than one of the other sides.

16. The golf club grip of claim 15, wherein the irregular pentagon-shaped five-sided cross-section of the body has at least one of a contoured periphery and rounded angles.

17. The golf club grip of claim 15, wherein the irregular pentagon-shaped five sided cross-section of the body has a consistent cross section along a longitudinal length.

18. The golf club grip of claim 17 further comprising:

the consistent cross section of the body extending along an entire longitudinal length of the elongated body.

19. A golf club grip comprising:

an elongated body having an irregular pentagon-shaped five-sided cross-section with a contoured periphery and a consistent cross section along a longitudinal length, the consistent cross section extending along an entire longitudinal length of the elongated body, the elongated body having first and second apertures defining hollow cylindrical openings through one longitudinal end of the body, each of the first and second apertures having a longitudinal axis, the longitudinal axes of the first and second apertures extending parallel to one another, the longitudinal axes defining a plane extending in a direction generally perpendicular to a putter head face to be assembled to the body for right handed and left handed golfers, the irregular pentagon-shaped five-sided cross-section of the body having a side of longest dimension extending generally parallel to the plane defined by the longitudinal axes of the first and second apertures, wherein a putter shaft to be located in either of the first and second apertures during assembly selectively provides either an offset position or an onset position of a putter face with respect to the body.

20. The golf club grip of claim 19 further comprising:

a cylindrical plug for closing any unused aperture in the body during assembly.

* * * * *